United States Patent [19]

Roeser

[11] Patent Number: 4,762,972

[45] Date of Patent: Aug. 9, 1988

[54] ENCLOSED EXTERNALLY ACTUATED SWITCH ASSEMBLY

[75] Inventor: John O. Roeser, Barrington, Ill.

[73] Assignee: Otto Engineering, Inc., Carpentersville, Ill.

[21] Appl. No.: 931,531

[22] Filed: Nov. 14, 1986

[51] Int. Cl.[4] ..... H01H 9/04

[52] U.S. Cl. ..... 200/302.1; 200/153 T; 200/47

[58] Field of Search ..... 200/302.1, 47, 153 T; 277/135, 59, 79

[56] References Cited

U.S. PATENT DOCUMENTS

| | | | |
|---|---|---|---|
| 2,817,736 | 12/1957 | Bastian | 200/302.1 |
| 2,878,348 | 3/1959 | Haydon et al. | 200/302.1 |
| 3,053,950 | 9/1962 | Dobes | 200/47 |
| 3,458,679 | 7/1969 | Russell et al. | 200/302.1 |
| 3,905,450 | 9/1975 | Persson | 277/59 |

FOREIGN PATENT DOCUMENTS

| | | | |
|---|---|---|---|
| 1089337 | 4/1984 | U.S.S.R. | 27/135 |

*Primary Examiner*—Renee S. Luebke
*Attorney, Agent, or Firm*—Robert D. Silver

[57] ABSTRACT

A precision subminiature, snap action switch and an externally actuated, heavy duty, spring loaded self-return type operator therefor are enclosed within an hermetically sealed housing. The operator employs a switch actuating cam having shoulders cooperable with shoulders on the interior of the housing to define the limits of cam movement, said cam also having a shoulder cooperable with a shoulder on a switch lever to trip the switch upon movement of the externally actuated operator shaft a precise amount away from its at rest position. A connector/switch subassembly sealingly closes a housing opening, provides a rigid, precision mounting for the switch, and also provides external electrical connections for the switch. The operator has an externally projecting shaft which extends through a shaft bearing/rotary seal assembly employing a silicone rubber O-ring member and oil for lubricating a shaft bearing and the O-ring member, there being additional polytetrafluoroethylene O-ring members which prevent escape of the lubricating oil. An end cap sealingly closes another housing opening, provides a bearing for the inner end of the operator shaft, and exerts a predetermined stress on the operator spring. The structure lends itself to a simplified fabrication method.

24 Claims, 2 Drawing Sheets

ENCLOSED EXTERNALLY ACTUATED SWITCH ASSEMBLY

BACKGROUND OF THE INVENTION

This invention relates to enclosed, heavy duty, externally actuated electric switches which are characterized by their rugged and compact construction, high precision and reliability, as well as high resistance to a wide variety and range of environmental factors.

In the development of vehicles, for example terrestrial, marine and airborne vehicles, the level of ruggedness, sophistication, precision and long term reliability demanded of components, particularly in military and certain other applications, far exceeds that heretofore required in similar vehicles. Moreover, many environmental factors such as vibration, mechanical and thermal shock, high gravitational forces, changes in orientation, barometric pressure and others tend to adversely affect the operation of precision components. Precision electrical switches are typical of precision components in the nature of control devices whose operating characteristics have been particularly subject to the adverse effects of such environmental factors.

SUMMARY OF THE INVENTION

With the foregoing in mind, it is a general object of the present invention to provide a precision electrical switch assembly of rugged and compact construction which is particularly resistant to environmental factors which have adversely affected the operating characteristics of prior art precision switches.

A further object of the present invention is to provide a precision electrical switch assembly of the class described which is externally actuated and has an hermetically sealed housing, there being improved resilient seal means surrounding an externally projecting actuator shaft.

Another object of the invention is to provide a switch assembly as aforedescribed which incorporates therein a subminiature switch in which is mounted for actuation by a movable cam member carried by the actuator shaft, the cam member being biased toward an initial position by heavy duty spring means which imparts a self-return characteristic to the switch assembly.

Another object of the invention is to provide a switch assembly of the aforementioned character which includes a housing having an end opening and an end cap which closes that opening by being sealingly welded to the housing, said end cap being cooperable with the spring means in a manner such that during fabrication of the improved switch assembly and prior to welding of the end cap to the housing, the end cap is positioned in a manner effective to cause the spring means to bias the cam against a stop shoulder with predetermined force, and while the end cap is held in that position, the end cap is welded to the housing.

A further object of the invention is to provide a switch assembly of the aforedescribed character wherein the end cap, in addition to providing means for anchoring an end portion of the spring means, also provides a bearing for the inner end of the actuator shaft.

A further object of the invention is to provide a switch assembly of the class described which includes a connector/switch subassembly which sealingly closes a second housing opening and provides a precision mourting for the subminiature switch, as well as electrical connection of the switch terminals to externally projecting leads of the connector assembly.

A still further object of the invention is to provide a switch assembly of the class described which is characterized by the simplicity of its construction and fabrication, and by the adaptability thereof to the use therein of alternative subminiature switches without necessitating any substantial changes in fabrication procedures or the structure of the switch actuating mechanism embodied therein.

BRIEF DESCRIPTION OF THE DRAWINGS

In the drawings, which illustrate the presently preferred embodiment of the invention.

DESRIPTION OF THE PREFERRED EMBODIMENT

Figure 1:
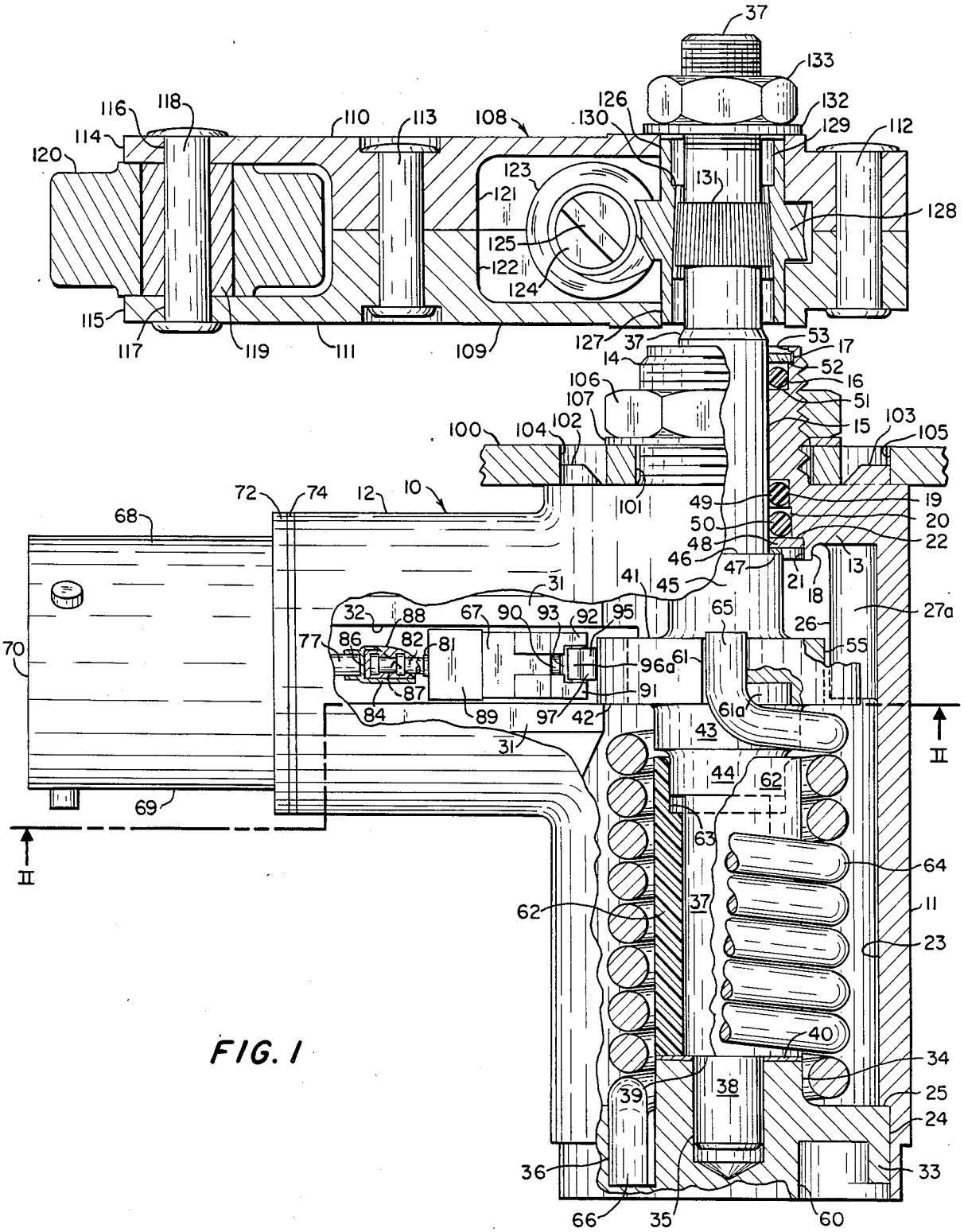
FIG. 1 is an side view of the improved switch assembly, parts being broken away and shown in vertical section.

Referring to the drawings, the improved switch assembly comprises an enclosure or housing 10, preferably of relatively thick, investment cast stainless steel, having a tubular cylindrical main body portion 11 (FIG. 1) and a tubular cylindrical arm 12 whose axis intersects and is normal to the axis of the main body portion 11. The housing 10 is formed with a transverse wall 13 extending across the upper end of the main body portion 11, said wall being formed with an upstanding, reduced diameter, externally threaded cylindrical tubular projection 14 which is coaxial with the main body portion 11.

The tubular projection 14 has a coaxial bore 15 which, at its upper end, is counterbored as at 16 and 17. The transverse wall 13 is formed with a downwardly projecting annular boss 18, and the lower portion of the bore 15 within the transverse wall 13 is counterbored as at 19, 20, and 21. The counterbore 21 provides an annular shoulder 22 which is in a plane normal to the axis of the bore 15. The tubular housing portion 11 has a coaxial bore 23, the lower end of which is counterbored, as at 24, to form an annular shoulder 25 which is in a plane normal to the axis of the bore 23.

Figure 2:
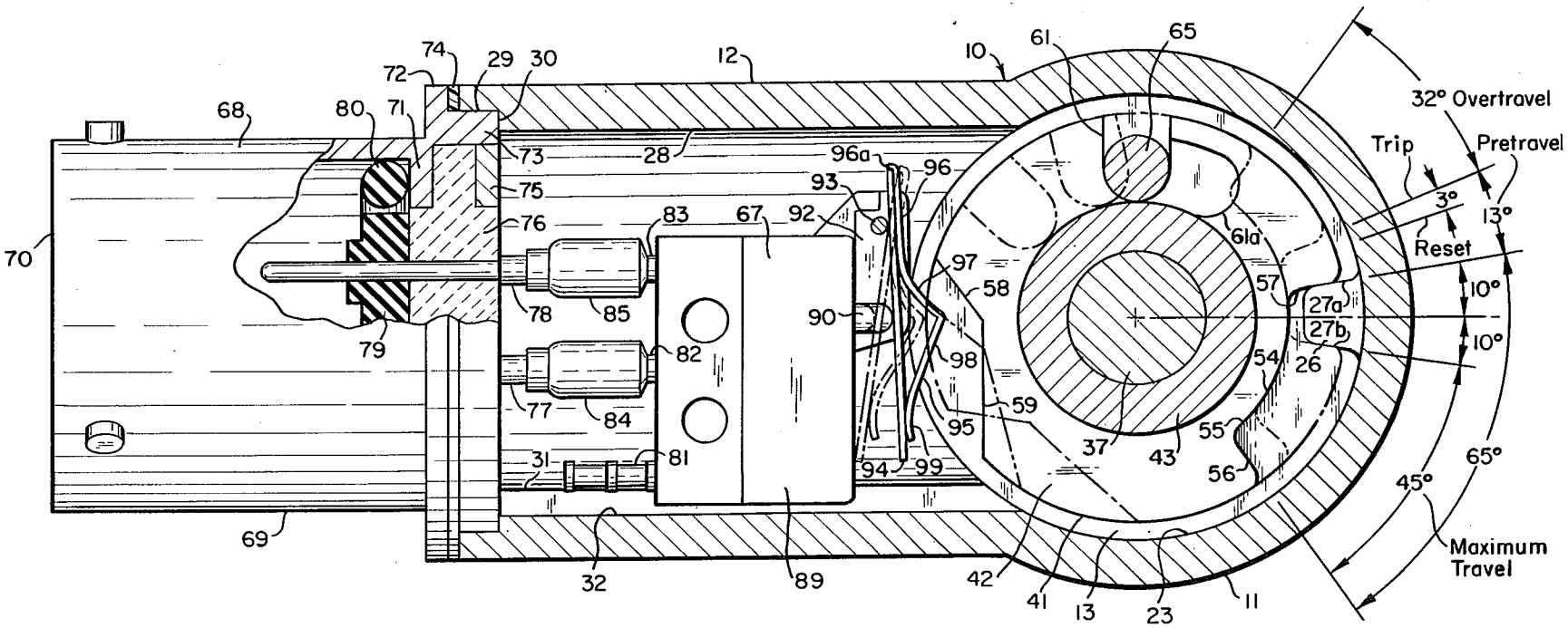
FIG. 2 is a transverse or horizontal sectional view on an enlarged scale taken generally along the line II—II of FIG. 1, parts being broken away and shown in section.

Formed on the interior of the housing 10 is an integral stop shoulder 26 which is of generally trapezoidal cross section and which extends downwardly from the wall 13 along the surface of bore 23 diametrically opposite the tubular housing arm 12, and centered on the axis of the latter. The stop shoulder 26 is provided with generally planar opposite sidewall surfaces **27*a* and 27*b* which extend radially with respect to the axis of bore 23. Each of surfaces 27*a* and 27*b* is disposed at an angle of 10 degrees with respect to the axis of housing arm 12 as shown in FIG. 2**.

The tubular housing arm 12 has a bore 28 which is counterbored, as at 29, to form an annular shoulder 30 which is normal to the axis of bore 28. As shown in FIG. 2, one side of the tubular arm 12 is thickened, as at 31, and is formed with an internal rectangular groove 32 which extends parallel with the axis of bore 28 for a purpose which will hereinafter appear.

Referring to FIG. 1, a cylindrical end cap 33 is seated in the counterbore 24 and against the annular shoulder 25. The end cap 33 is formed with an upstanding coaxial cylindrical boss 34 which is formed with a coaxial cylindrical bearing recess 35. The end cap 33 is also formed with a cylindrical recess 36 extending downwardly from the upper surface thereof parallel with the axis of the end cap and generally tangential to boss 34. The end cap 33 is further formed with shoulder means, preferably in the form of a pair of oblong, spaced, diametrically opposed, recesses 36 in the outer surface thereof. Only one recess 36 is shown in FIG. 1, and it is shown offset 90 degrees from its actual position for the sake of simplicity of illustration. The recesses 36 are adapted to receive portions of cooperable tool means for a purpose which will be decribed hereinafter. The end cap 33 is preferably made of stainless steel, and is sealingly laser welded to the housing portion 11 around its entire periphery.

Extending coaxially within the main body portion 11, is a shaft 37 having a reduced diameter lower end portion 38 providing a downwardly facing annular shoulder 39. A brass washer 40 coaxially overlays the flat upper surface of the boss 34, and the shaft end portion 38 is journalled within the axial recess 35 of the end cap, the annular shoulder 39 of the shaft coaxially overlaying the inner peripheral portion of washer 40 as shown. The upper end of the shaft 37 projects externally of the housing 10 through the upstanding tubular projection 14 and is journalled in the bore 15 of the latter between the counterbores 16 and 19.

The shaft 37 carries a tubular actuating member or cam 41 coaxially fixed thereon, as by laser welding, and which, like the shaft 37, is preferably formed of stainless steel. The cam 41 has an enlarged diameter generally cylindrical intermediate portion 42 which is generally in alignment with the rectangular groove 32 and the axis of the tubular housing arm 12. The cam 41 has a first downwardly projecting coaxial cylindrical portion 43, as well as a smaller diameter downwardly projecting coaxial cylindrical portion 44 whose diameter substantially matches that of the end cap boss 34. The cam 41 also has an upwardly projecting coaxial cylindrical portion 45 which terminates in an annular upper end surface or shoulder 46 which is normal to the axis of shaft 37.

A brass washer 47 coaxially overlays the annular shoulder 46, and a stainless steel washer 48 coaxially overlays the brass washer 47 and is seated in the counterbore 21 against the annular shoulder 22 thereof. Coaxially surrounding the shaft 37 within the counterbore 19 is an O-ring seal member 49, and coaxially surrounding shaft 37 within the counterbore 20 is an O-ring seal member 50. The O-ring 49 is preferably formed of resilient silicone rubber, whereas the O-ring 50 is preferably formed of polytetrafluoroethylene.

Coaxially surrounding the shaft 37 within the counterbore 16 at the outer end of tubular projection 14 is an O-ring seal member 51 which is preferably formed of polytetrafluoroethylene. Also coaxially surrounding the shaft 37 and seated within the counterbore 17 is a stainless steel washer 52 which is retained in the counterbore 17 by staking, as at 53. The spaces within the counterbores 16, 19 and 20 between the O-ring members 50 and 51 and not occupied by O-ring member 49, as well as the interface between the shaft 37 and bearing 15, are filled with a high grade, low or medium viscosity lubricating oil. This oil preferably takes the form of a P1 SF-CC-DD synthetic motor oil, one brand of which is marketed nationally under the trademark MOBIL 1 ® by Mobil Oil Corporation.

The O-ring members 50 and 51 have a radially compressive fit between the surface portions of shaft 37 and of counterbores 20 and 16 in contact therewith, respectively, such compressive fit being sufficient to prevent passage of the oil past said O-ring members under a pressure differential of one atmosphere. The silicore rubber O-ring 49 has a compressive fit between the surface portions of the shaft 37 and of counterbore 19 in contact therewith, such fit being sufficient to prevent the passage of a gas therepast at a rate exceeding $10^{-6}$ cc/sec.

The oil serves several functions. It lubricates the O-ring member 49 to prevent galling thereof upon rotation of shaft 37, as well as providing lubrication of the shaft within the bearing therefor provided by bore 15. It also fills the microscopic pores and crevices in the O-ring, as well as the microscopic surface irregularities of the portions of the shaft and bore in contact with the O-ring.

It will be understood by those skilled in the art that, while the illustrated use of the seal structure is in an enclosed switch assembly in which there is limited rotary motion of the shaft within the bore, the seal structure is well adapted for use in other applications wherein the shaft undergoes a different type of motion within the bore, such as continuous or intermittent rotary motion, axial motion or combinations thereof.

While the preferred form of seal structure is shown and described, it is understood that the invention also contemplates an alternative construction wherein one or more of the O-rings members 51, 49, and 50, are dispresed within circumferential grooves formed in the shaft 37, rather than within the counterbores 16, 19 and 20 respectively.

As best shown in FIG. 2, the cylindrical large diameter portion 42 of cam 41 is formed with an arcuate peripheral cutaway portion 54 defined by a coaxial reduced diameter intermediate cylindrical surface portion 55 and a pair of generally planar radially extending end surfaces 56 and 57. In the illustrated embodiment of the invention, the radial surfaces 56 and 57 form an angle of 65 degrees. The cam portion 42 is also formed with a peripheral cutaway portion defined by intersecting planar surfaces 58 and 59 which, in the illustrated embodiment, are generally parallel with the axis of the shaft 37. With the parts in the at rest or free portion shown in FIG. 2, the surface 58 forms an angle of 55 degrees with the axis of housing arm 12, and the surface 59 is normal to that axis as shown. The cam portion 42 is further formed with a generally U-shaped peripheral cutaway portion 61 having a semicylindrical inner end surface whose axis is parallel with that of the shaft 37, said inner end surface being tangential with the cylindrical surface of the cam portion 43. The cam portion 42 is also formed on its underside with a generally U-shaped recess 61*a* communicating with the cutaway portion 61 as shown in FIGS. 1 and 2.

Referring to FIG. 1, a tubular cylindrical sleeve or bushing 62, preferably of organoplastic material, has a telescopic fit on the shaft 37. The lower end of the sleeve 62 overlays the upper surface portion of brass washer 40 radially outwardly of the portion thereof overlaid by the shaft shoulder 39, and the upper end of said sleeve is counterbored, as at 63, to telescopically receive the cylindrical portion 44 of the cam member 41 as shown. It will be observed that the outer diameter of the sleeve 62 is generally the same as that of the axial boss 34 of end cap 33, washer 40 and the cylindrical portion 43 of the cam member 41 as shown. A heavy duty helical torsion spring 64 of uniform diameter surrounds the bushing 62, boss 34 of end cap 33 and cylindrical cam portion 43 in substantially coaxial relation. The spring 64 has opposite end portions 65 and 66 which are generally parallel with the axis thereof. The curvature through which the wire of the spring 64 is bent at both end portions 65 and 66 is of generous radius and is best illustrated at the upper end of spring 64 in FIG. 1. As there shown, the radius of curvature of the axis of the spring wire is generally equal to the diameter of said wire. Extensive spring life is insured by the use of such generous radii of curvature, in combination with the use of spring wire of material and size which provides a spring capable of withstanding stresses at least twice as great as those to which it is exposed in use.

The spring end portion 66 is seated in the end cap recess 36, whereas the spring end portion 65 is anchored in the peripheral cutaway portion 61 of cam 41, as shown in the drawings. The recess 61*a* in cam portion 42 provides relief preventing the imposition of sharp bending stress on the adjacent upwardly curved portion of the spring end 65. A similar recess (not shown) formed in the upper face of the end cap 33 provides similar relief for the downwardly curved portion of the spring end 66. The rotational position of the end cap 33 within counterbore 24 is preferably such that it torsionally stresses the spring 64 by the imposition thereon of a predetermined torque acting in a clockwise direction as viewed from the outer end of housing portion 11, as well as in FIG. 2. Such loading of the spring 64 is effective to cause the radial cam face 57 to engage the radial face 27*a* of housing stop shoulder 26 with a force of approximately 24 pounds.

The bushing 62 functions to retain the substantial coaxiality of the spring 64 with respect to the shaft 37 under the clockwise stress imparted to the spring by the end cap 33, as well as that created by counterclockwise rotation of the shaft 37 against the bias of said spring. Such rotational stress causes a slight reduction in the diameter and a concurrent slight increase in the length of spring 64. This creates an upward force on cam 41 which causes annular cam shoulder 46 to press upwardly on washer 48, thereby keeping washer 48 firmly seated in counterbore 21 against the annular shoulder 22.

Mounted within the housing arm 12 is switch 67 which is preferably in the form of a subminiature snap action switch which, with a connector 68, forms a switch/ connector subassembly. The connector 68 closes the outer end of housing arm 12 and is provided with a metallic tubular cylindrical body 69 having an open outer end 70. As shown in FIG. 2, the connector body 69 is formed at its inner end with a radially inwardly directed annular flange 71 and a radially outwardly directed annular flange 72, and it terminates in a relatively short coaxial tubular cylindrical end portion 73. Cylindrical end portion 73 is telescopically seated in the counterbore 29 against the annular shoulder 30 thereof. The annular space surrounding the tubular end portion 73 between the annular flange 72 and the outer end of the tubular housing arm 12 is preferably filled with epoxy material 74 which is flush with the outer surfaces of flange 72 and tubular arm 12. A metallic washer 75 fits coaxially within the end of the tubular cylindrical portion 73 and is suitably peripherally affixed thereto, as by welding. The inner end of the connector body 69 is closed by a seal 76 which is preferably of glass or ceramic material and is sealing fused to the connector body portions in contact therewith. A pair of spaced parallel rod-like connector leads 77 and 78, of electrically conductive metal such as copper, extend in sealingly fused relation through suitable apertures in seal 76 and have rounded outer ends thereof exposed within the connector body 69 as shown. A resilient cushion disc 79 of electrically insulating material such as silicone rubber overlays the outer surface of the seal 76 within the connector body 69 and is apertured to permit snug passage therethrough of the connector pins 77 and 78. An O-ring member 80 of resilient electrically insulating material such as silicone rubber surrounds the disc 79 in spaced relation and overlays the outer surface of the annular flange 71 as shown. The disc 79 and O-ring 80 are adapted to be compressed by the inner end of a fitting (not shown) positionable within the connector body 69 and adapted to provide a removable electrical connection between the pins 77 and 78 and a circuit (not shown) to which the switch 67 is thereby connected.

The outer surface of the tubular cylindrical body portion 73 is sealingly laser welded to the mating cylindrical surface of the counterbore 29, such seal extending circumferentially completely around the body portion 73. The connector 68 thus acts as an end cap which sealing closes the outer end of the tubular housing arm 12.

The switch 67, in the illustrated embodiment, is preferably a subminiature, precision, snap action, single pole, double throw switch of the general type disclosed in U.S. Pat. No. 3,878,347. It is commercially available as Model No. B2-5021-21 from Otto Controls Division, Otto Engineering, Inc., 2 East Main Street, Carpentersville, Ill. 60110.

The illustrated switch 67 has three spaced parallel terminal pins 81, 82, and 83 of the double turret type, the pins 82 and 83 being respectively coaxial with the connector leads 77 and 78. The inner ends of the connector leads 77 and 78 have telescopically fused thereon tubular connector slceves 84 and 85, respectively, which are preferably also made of copper. As best shown in FIG. 1, the connector sleeve 84, which is identical with the connector sleeve 85, has a transverse wall 86 extending thereacross to define a cup-shaped cylindrical recess in which the inner end of the connector lead 77 is telescopically received. The terminal pin 82 of switch 67 extends coaxially into the sleeve 84, and the terminal pin 83 similarly extends into the sleeve 85. The inner end of each of the sleeves 84 and 85 is cut off at an angle as indicated by the broken line 87 in FIG. 1 to facilitate the introduction of molten solder into each of said sleeves and in surrounding relationship with the respective terminal pins therein. By such soldering, the switch terminal pins 82 and 83 are fixed in coaxial relation with connector pins 77 and 78, respectively, through the connector sleves 84 and 85.

The telescopic soldered connection of switch terminal pins 82 and 83 with connector leads 77 and 78 just described, not only provides an electrical connection between said pins and connector leads, but it also provides a rigid mounting for the switch 67 on the connector 68. Such mounting avoids the use of conventional switch mounting brackets, thereby simplifying the structure, reducing cost and possibly reducing some tolerance problems attendant to the use of mounting brackets. It will be observed that with the switch so mounted, an edge portion thereof is accomodated within the rectangular groove 32 formed on the interior of housing arm 12.

As earlier mentioned, the switch 67 is of the single pole, double throw type. However, in the illustrated embodiment of the invention, the switch 67 functions as a normally open single pole single throw switch. Hence, the terminal pin 81 is not used. The switch 67 preferably has an organoplastic body 89 enclosing the working parts and contacts thereof. A cylindrical axially movable switch button 90, which is coaxial with the axis of housing arm 12, has a rounded outer end and is coaxially slidable in a suitable cylindrical aperture formed in the inner edge wall of the body 89. Button 90 is biased axially outwardly toward the free or unactuated position thereof shown in solid lines in FIG. 2.

The switch body 89 is formed with a pair of spaced parallel flanges 91 and 92 on opposite sides of the button 90, said flanges being apertured to provide journals for the opposite ends of a pivot pin 93. In FIG. 2 the flange 91 is removed in order to expose the switch parts between flanges 91 and 92. An elongated flat rectangular stainless steel switch actuating lever 94 is welded near one of its ends to an intermediate portion of pin 93. The lever 94 is thus mounted for pivotal movement about the axis of the pin 93 between the flanges 91 and 92, and it engages the outer end of the switch button 90. The lever 94 carries an elongated rectangular irregularly shaped lever 95 of beryllium copper having a flat end portion 96 which overlays the portion of the lever 94 between the pin and the adjacent end of said lever, the end portion 96 terminating in a portion **96*a* which is bent at a right angle thereto around the adjacent end of the lever 94 as shown. The flat lever portion 96 is fixed, as by welding, to the lever 94**.

The lever 95 has a generally V-shaped intermediate portion which extends away from the lever 94 and is defined by an arcuate shoulder extent 97, and a rectilinear extent 98 which is angled with respect to the extent 97 and terminates in an arcuate end portion 99 which overlays the lever 94. As shown in FIG. 2, the shoulder extend 97 of lever 95 is positioned for engagement by the planar cam surface 58 on rotation of cam 41, and the apex portion of said lever at the juncture of extents 97 and 98 is positioned for engagement by the cylindrical peripheral surface of the cam portion 42 upon further rotation of cam 41, as shown in single dot and dash lines in FIG. 2.

It is understood, of course, that actuation of the switch 67 by clockwise rotation of the shaft 37 and cam 41 is merely illustrative of the preferred form of the invention. The arrangement and configuration of the assembled parts could, if desired, be such as to provide for similar switch actuation in response to counterclockwise rotation of the shaft 37 and cam 41.

Referring to FIG. 1, the tubular projection 14 on the housing 10 provides means for mounting the improved switch assembly to a panel or other structural member 100 having an aperture 101 through which said projection extends as shown. The upper surface of the transverse housing wall 13 is formed with spaced cylindrical alignment pins 102 and 103 which are aligned with the axis of the housing arm 12 on opposite sides of the projection 14, and are respectively received in alignment bores 104 and 105 in member 100. The disposition of the alignment pins 102 and 103 in bores 104 and 105 prevents rotary movement of the housing 10 about the axis of shaft 37. The housing 10 is secured to the member 100 by a nut 106 threaded on projection 14, said nut engaging a cooperable lock washer 107 which overlays the member 100.

Means external to the housing 10 is provided for actuating the shaft 37, and in the illustrated embodiment, such means includes a roller actuated lever assembly 108 carried by said shaft. The assembly 108 comprises a lever arm 109 which is preferably formed of a pair of substantially identical complementary sections 110 and 111 fixed in assembled relation by rivets 112 and 113 which extend through suitable apertures in said lever sections. The outer ends of the lever sections 110 and 111 terminate in projecting ear portions 114 and 115 which are in spaced parallel relation and are formed with bores 116 and 117 for receiving a brass rivet 118. Mounted for rotation on the cylindrical intermediate portion of the rivet 118 between ears 114 and 115 is a coaxial stainless steel sleeve 119 which has coaxially fixed thereon a roller 120 which is preferably formed of linen base phenolic material.

The lever arm sections 110 and 111 are recessed, as 121 and 122, to provide an internal cavity for accomodating a stainless steel worm 123 and a cooperating tubular stainless steel worm gear 128. The worm 123 has cylindrical end portions which are journalled for rotation in suitable horizontal bores formed in lever arm 109, the end portion 124 shown in FIG. 1 being externally exposed and formed with a diametrical slot 125. The lever sections 110 and 111 are formed with coaxial vertical bores 126 and 127 in which cylindrical opposite end portions of the gear 128 are journalled. Gear 128 has a coaxial bore 129 which is somewhat larger than the diameter of the shaft 37, and intermediate its length, the bore 129 is formed with a tapered or frustoconical splined portion 130. The inner and outer diameters of splined portion 130 are smaller at the upper end than at the lower end thereof.

Spaced above the tubular projection 14 of housing 10, the reduced diameter upper end portion of shaft 37 is formed with an enlarged diameter extent of tapered or frustoconical knurling 131. The tapered knurling 131 is complementary to the tapered internal splining 130 on the gear 128, and the inner and outer diameters of the upper and lower ends of the knurling 131 are intermediate those at the opposite ends of the splining 130. A stainless steel washer 132 surrounds the shaft 37 and overlays the lever arm 109, and a lock nut 132 is threaded on the shaft 37 in engagement with the washer 31 as shown.

Tightening of the lock nut 132 causes downward movement therewith of the lever arm 109 and abutment of said lever with the upper surface of the gear 128. Further tightening of nut 133 tightens the fit of the tapered gear splines 130 with the shaft knurling 131 and frictionally binds the lever arm 109 to gear 128. The arm 109 is thus locked against rotation with respect to the gear 128 and shaft 37.

The free position of the arm assembly 108 with respect to the shaft 37 is adjustable for an infinite number of positions through 360 degrees. This can be accomplished by loosening the lock nut 133 to release the lever 109 from binding engagement with gear 128, and then rotating the worm 123 by means of a screw driver or other tool inserted in the slot 125 thereof. When the selected position of the lever arm assembly 108 with respect to the shaft 37 is reached, the lock nut 132 is again tightened to secure the lever assembly 108 in the selected position.

Referring now to FIG. 2, the operation of the illustrated switch 67 will now be described. Tripping of the switch, i.e., snap action of its movable contact from its initial open position to its actuated or closed position in engagement with the coacting fixed contact, is effected by predetermined depression of the button 90 from its initial unactuated position to the trip position thereof. Such button movement is referred to as pretravel movement.

Further depression of the button 90 beyond its trip position is referred to as overtravel movement. Upon return movement of button 90, the movable switch contact snaps back, or is reset, to its initial open position somewhat after the button 90 passes the trip position thereof. The position of the button at which such resetting occurs is referred to as the reset position. The difference between the trip and reset positions of the button 90 is referred to as the movement differential.

Some of the characteristics of the switch 67 embodied in the presently preferred form of the invention, are as follows, Pretravel: 0.008 to 0.018 inch
Overtravel: 0.010 inch minimum
Movement differential: 0.003 inch maximum
Operating force: 6 oz. maximum
Probable mechanical life: 200,000 operations
Probable electrical life: 50,000 operations
Ambient temperature range: −55 degrees C. to 85 degrees
Stationary contacts: silver inlay
Movable contact: silver
Electrical Ratings In Amperes:

| | At Sea Level | | At 50,000 Feet |
|---|---|---|---|
| Load | 28 VDC | 115 VAC 60 HZ | 28 VDC |
| Resistive | 7 | 7 | 4 |
| Inductive | 5 | 7 | 2.5 |
| Lamp | 2.5 | 2 | 2.5 |
| Dielectric Withstanding Voltage | 1050 VRMS | 1050 VRMS | 400 VRMS |

In FIGS. 1 and 2 of the drawings, the parts are illustrated in the normal at rest or free position in which the switch contact is open and the radial surface 57 of cam 41 (FIG. 2) engages the radial surface 27*a* of stop shoulder 26 with the aforementioned predetermined force under the bias of spring 64.

Actuation of the illustrated switch assembly is accomplished by applying an acuating force or torque to the roller 120 of the lever assembly 108. This actuating torque is applied in a clockwise direction, as viewed from the top of FIG. 1, and in a counterclockwise direction as viewed in FIG. 2. The torque necessary to effect rotary movement of the shaft 37 and cam 41 against the bias of the spring 64 is of the order of 12 to 25 inch pounds. As shown in FIG. 2, the maximum possible rotation of the illustrated cam 41 is 45 degrees, since such rotation causes abutment of the radial cam surface 56 with the radial stop shoulder surface 27*b*. Such rotation of the cam 41 is shown in single dot and dash lines in FIG. 2.

With the surfaces 56 and 27*b* in abutment, the lever assembly 108 is capable of withstanding an actuating torque of at least 40 inch pounds applied to roller 120, and the maximum actuating torque applied to the roller 120 preferably does not exceed 40 inch pounds. Return travel of the shaft 37 and cam 41 under the bias of spring 64 occurs whenever the actuating torque applied to the roller 120 as aforedescribed is decreased to 9 inch pounds or less.

In FIG. 2, various angular relationships are specifically disclosed. Among these are the 65 degree angular relationship between the radial cam surfaces 56 and 57, the 20 degree angular relationship between the radial stop shoulder surfaces 27*a* and 27*b*, each of which is at an angle of 10 degrees from the axis of the tubular housing arm 12, and the maximum 45 degree permitted rotation of the cam 41. It is understood, of course, that if the improved switch assembly is to be used in an application requiring the lever assembly 108 to have a maximum arc of travel different from 45 degrees, it is only necessary to use a cam 41 having a radial cam surface 56 which, in the at rest position of the cam, is at an angle with respect to the radial shoulder surface 27*b* equal to the maximum arc of travel required in the particular application.

In the form of the invention illustrated, 13 degrees of counterclockwise rotation of the cam 41 from its initial or free position shown in solid lines in FIG. 2 to its trip position shown in double dot and dash lines in FIG. 2 is effective to cause the planar cam surface 58 to engage the arcuate extent 97 of the lever 95 and pivot the levers 94 and 95 to the left an amount effective to depress the switch button 90 0.008 to 0.018 inch to its trip position, causing the movable contact of switch 67 to snap into engagement with the stationary contact thereof. Thus, the pretravel rotation of the cam 41 illustrated in FIG. 2 effects the corresponding axial pretravel of the button 90 required to trip the switch 67.

Counterclockwise rotation of cam 41 beyond its trip position causes planar cam surface 58 to sweep along the arcuate extent 97 of lever 95 and pivot the levers 94 and 95 away from the cam 41 until the intermediate apex portion of the lever 95 is engaged by the cylindrical peripheral surface of the cam portion 42. Such rotation of the cam 41 beyond its trip point is illustrated as overtravel of said cam, and as FIG. 2 further illustrates, 32 degrees of cam overtravel is possible in the illustrated embodiment of the invention. As aforementioned, the maximum overtravel position of the cam 41 is illustrated in single dot and dash lines in FIG. 2. Also illustrated in single dot and dash lines in FIG. 2 is the position to which the levers 94 and 95 are moved by contact of the intermediate apex portion of the lever 95 with the cylindrical peripheral surface of the cam portion 42.

Also illustrated in FIG. 2 is the three 3 degree differential between the trip and reset positions of the cam, which differential corresponds to the 0.003 inch differential between the trip and reset positions of the switch button 90. Thus, upon return (clockwise) movement of the cam 41 toward its initial position, the movable contact of switch 67 snaps to its normally open position as the cam 41 and switch button 90 reach their reset positions.

The characteristics of the improved switch assembly are such that, upon instaneous removal of the actuating torque from the roller 120 while the cam 41 is in an overtravel position, the bias of the spring 64 substantially instaneously returns the cam 41 to its initial position, and the movable contact of the switch 67 snaps to its normally open position within 100 milliseoonds after the the actuating torque is removed from roller 120. The expected mechanical life of the disclosed switch assembly is 25,000 cycles, and the expected electrical life is also 25,000 cycles. Throughout the life of the switch assembly, the trip position of the cam 41, and the corresponding position of the roller actuated lever assembly 108 is expected to be repeatable within a 1 degree range.

The structure of the improved switch assembly lends itself to a particularly efficient and simple method of fabrication. Prior to final assembly, the aforementioned switch/connector subassembly is fabricated. This is accomplished by inserting the switch terminal pins 82 and 83 telescopically into the connector sleeves 84 and 85, placing the connector 68 and switch 67 in a suitable fixture or jig (not shown) which holds them in the desired precise positional relationship with each other mentioned earlier herein. The sleeves 84 and 85 are then filled with molten solder to rigidly mount the switch 67 on the connector 68 and form a connector/switch subassembly which is then removed from the fixture.

Final fabrication of the switch assembly is preferably initiated by placing O-ring member 49 in counterbore 19 and then coaxially placing on the portion of shaft 37 outwardly of the annular shoulder 46 thereof, the brass washer 47, steel washer 48 and O-ring member 50. Using, for example, a medical type syringe introduced into the bore 15 through the open end of tubular projection 14, a few drops of lubricating oil are applied to the O-ring 49 within counterbore 19. The shaft 37, with the cam 41 coaxially fixed thereon, is then coaxially introduced into the open outer end of the housing portion 11. The threaded end of the shaft 37 is moved coaxially through the O-ring member 49 and bore 15, and such shaft movement is continued until the O-ring member 50 and washers 47 and 48 are seated in their operative positions shown in FIG. 1. During such movement the cam 41 is rotationally oriented so that the stop shoulder 26 is accomodated within the peripheral cutaway portion 54 of the cam.

The plastic sleeve 62 is placed coaxially on the shaft 37 with counterbore 63 thereof telescopically accomodating the cylindrical cam portion 44. The helical spring 64 is then placed coaxially around the sleeve 62, and the inner end portion 65 of the spring is inserted into the cutaway cam portion 61. Brass washer 40 is then coaxially placed on the end portion 38 of shaft 37 against the annular shoulder 39, and the end cap 33 is coaxially placed on said shaft end portion, the latter being received within the axial end cap recess 35, and the spring end portion 66 being received in the end cap recess 36.

With the housing 10 held in a suitable fixture or jig (not shown), a suitable tool (also not shown) cooperable with the shoulder means of the end cap, for example a tool having portions which fit into the recesses 60 of the end cap, is used to hold the latter in contact with annular housing shoulder 25 and to rotate it in a clockwise direction as viewed from below in FIG. 1, and as shown in FIG. 2, until a predetermined torque of 9 inch pounds is applied to the end cap and thereby to the spring 64. With the end cap held by the tool in the position to which it was rotated thereby for application of the predetermined torque, the housing is suitably staked into the end cap to rigidly hold the latter in the rotated position. The tool is then disengaged from the end cap 33 and the housing 10 is removed from the fixture.

Using a special fixture (not shown) which ensures proper positioning, the switch/connector subassembly previously fabricated is coaxially introduced into the outer end of the housing arm 12 and placed in the operative position shown in the drawings. It will be observed that spring 64 holds the cam 41 in the solid line at rest position thereof shown in FIG. 2, and that the switch lever 95 does not come in contact with the cam during such switch placement, because lever 95 is at that time accomodated within the cutaway peripheral portion of the cam defined by the planar surfaces 58 and 59. While the switch/connector subassembly is held by the special fixture in the position shown in the drawings, the outer end of the housing arm 12 is staked to the tubular cylindrical portion 73 of the connector body 69 to fix the connector/switch subassembly in the operative position shown. The special fixture is then disengaged from the switch assembly.

The end cap 33 is then laser welded within the counterbore 24, and the tubular portion 73 of connector body 69 is laser welded within the counterbore 29. The laser welds provide static hermetic seals circumferentially around the end cap 33 and the connector body portion 73, such seals, as well as the fused glass seals provided by connector 68, being effective to prevent passage of gas therepast at a rate greater than $10^{-8}$ cc/sec at a differential pressure of 1 atmosphere.

Lubricating oil is then introduced into the counterbore 16 through the open end of tubular projection 14, for example by the use of the aforementioned medical type syringe. This insures that the interface between bore 15 and the shaft 37 is supplied with lubricating oil. The O-ring member 51 and steel washer 52 are then placed coaxially in the counterbores 16 and 17 respectively, and the upper end of the tubular projection 14 is staked over the washer 52, as shown at 53, to secure the washer and O-ring member 51 in the operative positions shown. The oil is thus retained between the O-ring members 50 and 51.

The roller actuated lever assembly 108 is then installed on the upper end of the shaft 37 by coaxially meshing the tapered internal splines 130 of the gear 128 with the complementary tapered knurling 131 on the shaft 37. The washer 132 and locknut 133 are thereafter installed on the threaded upper end of the shaft 37. When placing the lever assembly 108 on the shaft 37, the final position thereof is approximated. With the gear splines in mesh with the shaft knurling, the worm 123 is rotated in the direction and by an amount necessary to position the assembly 108 in the precise free position thereof required for the particular application. The locknut 133 is then tightened to secure the lever assembly 108 in that precise position. Thereafter, any rotary motion imparted to the lever assembly 108 by an actuating force exerted on roller 120, results in identical rotary motion being imparted to shaft 37 and cam 41.

The improved switch assembly thus provides a number of unique and advantageous features which combine to permit fabrication thereof by a simplified, low cost method and which impart thereto the capability of high precision switching in a highly reliable and repeatable fashion on a long term basis, even when exposed to environmental factors tending adversely to affect the operation thereof.

Having disclosed and described a preferred embodiment of the improved switch assembly, it will be understood that various modifications and adaptations thereof will suggest themselves to those skilled in the art, and all of such modifications and adaptations are contemplated as will come within the scope of the appended claims.

What is claimed is:

1. An apparatus comprising a housing having a bore through a wall portion thereof; a shaft movably mounted within said housing and having a portion extending through said bore; and a rotary seal structure capable of preventing molecules of gas under a predetermined pressure differential from passing into or out of said housing between said bore and shaft, said rotary seal structure comprising; first and second resilient O-ring seal members surrounding said shaft and disposed in sealing relation with surface portions of said shaft and bore radially respectively inwardly and outwardly of said first and second resilient O-ring seal members; a third resilient O-ring seal member surrounding said shaft between said first and second O-ring seal members and disposed in sealing relation with surface portions of said shaft and bore radially respectively inwardly and outwardly of said third resilient O-ring seal member; and a quantity of lubricating oil within said bore and in contact with said third O-ring seal member, said first and second O-ring seal members being of a size and composition to prevent passage of said lubricating oil therepast within said bore, and said third O-ring seal member being of a size and composition to prevent passage therepast within said bore of gas molecules under a predetermined pressure differential.

2. The apparatus according to claim 1 wherein said bore is formed with enlarged diameter first, second and third annular surface portions with which said first, second and third O-ring seal members are respectively in sealing relation.

3. The apparatus of claim 1 wherein said first and second O-ring seals are made of polytetrafluoroethylene.

4. The apparatus of claim 1 wherein said third O-ring seal is made of silicone rubber, and the lubrication provided by said oil is effective to prevent galling of said third O-ring on movement of the shaft.

5. The apparatus of claim 1 wherein said shaft is mounted for rotation.

6. The apparatus of claim 1 wherein said shaft is mounted for reciprocal rotary movement through a predetermined angular range.

7. The apparatus of claim 1 wherein said bore provides a cylindrical shaft bearing surface portion between said third and at least one of said first and second O-ring seals.

8. The apparatus of claim 7 wherein said lubricating oil also provides lubrication for said shaft within said bore at said bearing surface portion.

9. The apparatus of claim 1 wherein said lubricating oil is a synthetic motor oil.

10. The apparatus of claim 1 wherein an actuatable control assembly is mounted within said housing, and said shaft carries means for actuating said control assembly in response to movement of said shaft.

11. The apparatus according to claim 1 wherein said housing also has a second bore spaced from and coaxial with said first mentioned bore, said second bore having an outer end, said housing also being provided with internal shoulder means, said shaft carries an actuating member intermediate its length, an end cap fixedly and hermetically sealingly closes said outer end of said second bore and is provided with an inwardly facing cylindrical bearing recess in which the adjacent end of said shaft is journalled, and a helical spring coaxially surrounds said shaft and has its opposite ends anchored to said actuating member and said end cap, respectively, said end cap being disposed in a position of rotation with respect to said housing such that said helical spring is stressed in a manner normally to bias said actuating member into engagement with said internal shoulder means with predetermined force to thereby define the initial position of said actuating member.

12. In combination, a housing having a tubular housing portion; said tubular housing portion having an outer end; a shaft extending coaxially within said tubular housing portion and having an adjacent end, said shaft having fixed thereon an actuating member formed with a shoulder portion, said housing having an internal shoulder portion adjacent said actuating member; an end cap closing the outer end of said tubular housing portion and having an inwardly facing cylindrical bearing recess in which said adjacent end of said shaft is journalled; and spring means within said housing, said spring means having portions engaging said actuating member and end cap respectively, said end cap being hermetically sealingly fixed to said tubular housing portion and disposed in a position which stresses said spring means in a manner normally to cause the said spring means to bias said actuating member shoulder portion into engagement with said internal shoulder portion with predetermined force and to thereby define an initial position of said actuating member.

13. An apparatus according to claim 12 wherein said tubular housing portion is sized to permit insertion therethrough of said shaft, actuating member and spring means prior to positioning and fixation of said end cap in closing relation with respect to said tubular housing portion.

14. An apparatus according to claim 12 wherein said housing also has a second tubular housing portion substantially coaxially aligned with said first tubular housing portion, said second tubular housing portion having said shaft coaxially extending therethrough, said second tubular housing portion providing a cylindrical bearing in which said shaft is journalled, and there is hermetic O-ring seal means surrounding said shaft within said second tubular housing portion.

15. The combination of claim 12 where in said housing has a second tubular housing portion whose axis is generally normally to that of the first-mentioned tubular housing portion, said combination additionally comprising a connector assembly having a wall portion which extends across the outer end of said second tubular portion in sealingly welded relation and through which projects in hermetically sealed relation a pair of spaced parallel connector leads; and a precision subminiature switch having a pair of spaced projecting parallel terminal pins which are respectively in soldered telescopic connection with said spaced parallel connector leads to thereby provide a precision mounting for said switch within said housing and electrical connections between said connector leads and the switch-terminal pins respectively connected thereto, said precision subminiature switch having an actuatable member movable from a first to a second position and being mounted in a position wherein said actuatable member is engaged by said actuating member and moved by the latter from its first to its second position by movement of said actuating member against the bias of said spring means a predetermined distance away from its initial position.

16. An apparatus according to claim 12 wherein said spring means is a helical torsion spring substantially coaxially surrounding said shaft between said end cap and actuating member and having its opposite ends anchored to said end cap and actuating member, respectively, to rotatively bias said actuating member and shaft.

17. The apparatus according to claim 16 which further comprises a cylindrical spacer sleeve coaxially surrounding said shaft within said helical spring and effective to maintain substantial coaxiality of said spring with respect to said shaft.

18. The apparatus according to claim 16 wherein said end cap is provided with end cap shoulder means adapted for engagement by tool means capable of applying a predetermined torque to said end cap and spring to locate the position in which the end cap is fixed to the housing and in a position to bias said spring.

19. The apparatus according to claim 16 wherein a precision subminiature switch is mounted within said housing and has an actuatable lever pivoted near one end thereof and movable from a first toward a second position; and a leaf spring overlays and is fixed at one end to said one end of said actuatable lever, said leaf spring having a generally V-shaped intermediate portion extending away from said lever and positioned for engagement by said actuating member and movable with said actuatable lever to said second position upon rotation of the actuating member through a predetermined arc against said bias of said spring means.

20. In combination, a connector assembly having a wall portion through which at least one connector lead projects in hermetically sealed relation; and a precision subminiature switch having at least one terminal pin projecting thereform and which has a soldered telescopic connection with said at least one connector lead to thereby provide both a precision mounting for said switch on said connector assembly and an electrical connection between said lead and terminal pin.

21. The combination of claim 20 wherein said switch has at least a pair of spaced parallel terminal pins and said connector assembly has at least a pair of spaced parallel connector leads respectively in soldered telescopic connection with said at least a pair of terminal pins.

22. The combination of claim 21 which further comprises a housing having a tubular extension formed with an outer end and having mounted therein a precision switch actuating mechanism, said connector assembly having a cylindrical portion closing said outer end of said tubular extension and hermetically sealingly welded thereto, said connector assembly supporting said switch in a precise position for actuation by said actuating mechanism.

23. A method of assembling a structure which comprises a housing having an internal shoulder and spaced coaxial first and second bores, said first bore having an inner end, a shaft having a remote and an adjacent end and carrying a cam member having a spring recess and having a peripheral shoulder; an end cap havinq a spring recess and adapted to close the second bore and provided with a coaxial bearing recess, and a helical torsion spring having axially extending opposite end portions adapted to fit into said spring recesses in said cam and end cap respectively, said method comprising placing the helical spring coaxially on the shaft with one end portion of the spring fitted into the spring recess therefore in said cam member; inserting the other end portion of the helical spring in the spring recess in said end cap and said adjacent end of the shaft coaxially into the bearing recess of the end cap; inserting the shaft with the spring and end cap assembled thereto coaxially through the second bore and into the first bore to bring said end cap in closing relation with respect to the outer end of said second bore; rotating said end cap axially of said second bore in an amount as necessary to stress said spring and cause the latter to bias the cam shoulder with predetermined force into engagement with said housing internal shoulder; then, while the end cap is held in its thus rotated position at the outer end of the second bore, sealingly welding said end cap to the housing.

24. The method of claim 23 wherein said first bore is provided with counter bore means at said inner end thereof adapted respectively to accomodate O-ring seal means and washer means, and said cam member has an annular end surface facing one end of the shaft, said method further comprising, prior to insertion of the shaft through the second bore, placing coaxially on said one end of said shaft adjacent said annualar end surface said washer means followed by said O-ring seal means, and the extent to which said shaft is inserted into said first bore is that which is sufficient to cause said annular cam end face to press said O-ring seal means and washer means into said counterbore means.

* * * * *